US006202703B1

(12) United States Patent
Kuroda et al.

(10) Patent No.: US 6,202,703 B1
(45) Date of Patent: Mar. 20, 2001

(54) CORROSION RESISTANT COPPER ALLOY TUBE AND FIN-TUBE HEAT EXCHANGER

(75) Inventors: Taro Kuroda; Motohisa Miyafuji; Kenju Minamoto; Mitsuhiro Ohkubo; Ryoichi Ozaki; Akinori Tsuchiya, all of Shimonoseki (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 0 days.

(21) Appl. No.: 08/250,607

(22) Filed: May 27, 1994

(30) Foreign Application Priority Data

May 27, 1993 (JP) ..... 5-126329
Jul. 2, 1993 (JP) ..... 5-164878
Jul. 7, 1993 (JP) ..... 5-168230

(51) Int. Cl.[7] ..... F16L 9/02

(52) U.S. Cl. ..... 138/178; 165/134.1; 165/133; 420/493; 420/499

(58) Field of Search ..... 165/133, 177, 165/905, 134.1; 420/493; 138/178

(56) References Cited

U.S. PATENT DOCUMENTS 1,214,539 * 12/1917 Goldschmidt et al. ..... 420/493 X
2,075,509 * 3/1937 Davis et al. ..... 420/493
2,123,628 * 7/1938 Hensel et al. ..... 420/493
2,131,437 9/1938 Jennison .
2,315,507 * 4/1943 Dean et al. ..... 420/493
2,712,992 7/1955 Pulsifer et al. .
4,059,437 11/1977 Nesslage et al. .
4,531,980 * 7/1985 Miura et al. ..... 165/905 X
4,658,892 * 4/1987 Shinohara et al. ..... 165/133

FOREIGN PATENT DOCUMENTS 732 565 3/1943 (DE) .
1278109 * 9/1968 (DE) ..... 420/493
1 608 189 12/1970 (DE) .
483 407 4/1938 (GB) .
2 073 250 10/1981 (GB) .
53-19920 * 2/1978 (JP) ..... 420/493
1 316431 12/1989 (JP) .

* cited by examiner

*Primary Examiner*—Allen Flanigan
(74) *Attorney, Agent, or Firm*—Oblon, Spivak, McClelland, Maier & Neustadt, P.C.

(57) ABSTRACT

The copper alloy tube disclosed here contains 0.05 to 1.5 wt. % of Mn and deoxidized copper containing oxygen concentration at 100 ppm or less. At least one element selected from a group of elements comprising P, B, Li, Pb and Sb can be added at the amount of 0.20 wt. % or less in total. At least one element selected from another group of elements comprising Cr, Ti, Zr, Al and Si also can be added at the amount of 0.50 wt. % or less in total. Further, at least one element selected from other group of elements comprising Mg, Fe, Co, Ag, In and As can be added at the amount of 1.0 wt. % or less in total. Furthermore, at least one element selected from a group of elements comprising Zn and Ni can be added at the amount 5.0 wt. % or less in total. Thereby, an corrosion resistant copper alloy tube having better corrosion resistant property against the ant-nest type corrosion which is specific problem for refrigerant tubes and tubes for the heat exchanger and also better brazing property can be provided.

2 Claims, 1 Drawing Sheet

CORROSION RESISTANT COPPER ALLOY TUBE AND FIN-TUBE HEAT EXCHANGER

BACKGROUND OF THE INVENTION

1. Field of the Invention

The present invention relates to an corrosion resistant copper alloy tube which is used as a refrigerant copper alloy tube or a heat exchanger copper alloy tube and a fin-tube heat exchanger which is used for an air-conditioner, particularly relates to an corrosion resistant copper tube and a fin-tube heat exchanger having improved corrosion resistant property against an ant-nest type corrosion.

2. Description of Prior Art

A tube which was made of copper deoxidized by phosphorous has been widely used for the conventional refrigerant tube or the conventional heat exchanger tube generally due to its better bending and brazing properties.

In these tubes, however, organic materials such as lubricant oil or process oil and organic solvents unavoidably remaining on the surface of the fins and tubes after the tubing and fabrication processes may decompose during the repeated deposit and evaporation of water due to a coolant and during the exposure to peculiar temperature/moisture and air-exchange environment created as a nature of its construction to form carboxylic acids which cause peculiar corrosion showing local ant-nest type corrosion on the surface of the tube.

Thus, a large amount of lubricant oil has been used in the fabrication process of the heat exchanger, however considering recent environmental problems there is a trend to avoid the degreassing wash by organic solvents and rather to use volatile lubricant oil instead of such organic solvents. In this case, even though the base oil itself is volatile, such lubricant oil still contains some oil additives which may remain on the surface of the copper tube.

Therefore, there is an increasing risk for the ant-nest type corrosion in future according to more usage of volatile lubricant oil, compared to the case the degrase wash was performed using organic solvents. Reflecting such circumstance, measurements for the ant-nest type corrosion are attracting the attention of the industry as one of serious problems. Further, increase of remaining organic materials on the surface of the copper alloy tube is creating another problem of poor conjunction of tube during the brazing which is used as a major method for the tube connection. Therefore, development of a copper alloy tube having superior corrosion resistant and brazing properties than the conventional phosphorous deoxidized copper tube is desired as a tube material for the refrigerant tube or the heat exchanger tube.

Further, the fin-tube heat exchanger used for an air-conditioner is generally fabricated using aluminum or aluminum alloy plate fins provided with tube insertion holes and copper tubes. Inside the insertion hole, a tube-type fin collar is provided. Many of said fins are placed in parallel and the copper tube is inserted into said fin collar so as to connect each fin. Then, this tube extended and fixed on the fins. And the heating medium is allowed to flow through the inside of said tube and its heat is transmitted to and radiated from said fins. In this fin-tube heat exchanger, said plate fins are made from aluminum or aluminum alloy due to its thermal conductivity and cost, and, for said tube, the copper tube is widely used from the stand points of its thermal conductivity and corrosion resistant properties. For this copper tube, a pure copper called as phosphorous dioxided copper is mainly used.

However, in these conventional fin-tube heat exchanger, organic materials such as lubricant oil and organic solvents used in the processes of blanking and extending of the tube unavoidably remain on the surface of the tubes, and these organic materials are affected by repeated deposit and evaporation of water during storage of fins and tubes or usage as the heat exchanger. These organic materials are also exposed to the peculiar temperature/humidity and air-exchange environment during usage of the heat exchanger. Under such conditions, these organic materials decomposed to form carboxylic acids which cause the peculiar local corrosion showing the ant-nest type corrosion, resulting in leakage of the tube frequently.

In addition, as aforementioned, although a large amount of lubricant oil has been used during fabrication process of the fin-tube heat exchanger, considering recent environmental problems there is a trend to avoid the degreassing wash by organic solvents and rather to use volatile lubricant oil instead of such organic solvents. Even though the base oil itself is volatile, such lubricant oil still contains some oil additives which may remain on the surface of the copper tube. Therefore, the amount of organic materials remaining on the surface of raw materials is in trend towards increase compared to the case of degreassing wash by organic solvents and the risk for the ant-nest type corrosion is higher than the past.

Under such circumstance, measurements for the ant-nest type corrosion of the fin-tube heat exchanger are attracting the attention of the industry as one of serious problems, and development of a fin-tube heat exchanger having superior corrosion resistant property against the ant-nest type corrosion is desired.

SUMMARY OF THE INVENTION

The object of the present invention is to provide an corrosion resistant copper alloy tube having better corrosion resistant property against the ant-nest type corrosion even though exposed to the phenomenon specific to the refrigerant tube or the heat exchanger tube; that is, repeated deposit and evaporation of water, and used under the peculiar environmental conditions of temperature/humidity and air-exchange, and having better brazing property so that capable of increasing its integrity and life span as the refrigerant tube or the heat exchanger tube.

The another object of the present invention is to provide a fin-tube heat exchanger having better corrosion resistant property against the ant-nest type corrosion even though affected by the phenomenon specific to the fin-tube heat exchanger; that is, repeated deposit/evaporation of water, and used under the peculiar environmental conditions of temperature/humidity and air-exchange so that carboxylic acids are formed, and capable of increasing its integrity and life span.

A corrosion resistant copper alloy tube according to the present invention consists essentially of 0.05 to 1.5 wt. % of Mn, 100 ppm or less of oxygen, and Cu and inevitable impurities.

The corrosion resistant copper alloy tube according to the present invention shows better corrosion resistant property against the ant-nest type corrosion which specifically may occur in the conventional refrigerant tube or the heat exchanger tube made of phosphorous deoxidized copper; that is, the ant-nest type corrosion which may occur under the conditions of affecting repeated deposit and evaporation of water and peculiar environmental conditions of temperature/humidity and air-exchange, and shows better brazing property. Therefore, it is capable of increasing its integrity, applicability and life span as the refrigerant tube or the heat exchanger tube. Thus, the present invention is very useful.

A corrosion resistant copper alloy tube for a heat exchanger according to the present invention, comprises a main tube body including a copper alloy tube and an oxide film formed on the surface of said main tube body in the thickness of from 30 to 3000 Å by oxidizing the surface of the main tube body. Said copper alloy consist essentially of at least one additive element at 1.7 to 3.0 wt. % in total, the volume ratio of oxide thereof to Cu base metal (ratio of molecular volume of oxide to atomic volume of Cu base metal) being within 1.7 to 3.0, and Cu and inevitable impurities. The additive element or elements remaining in said copper alloy is solid solubilized into Cu base metal. The differential natural electric potential between said oxide film and phosphorous deoxidized copper in 0.1 v. % of formic acid solution is within the range of from 0.2 V to −0.2 V.

In the conventional heat exchanger copper tube made of phosphorous deoxidized copper, the corrosion resistant property was obtained by the oxide film on the surface thereof. However, under the environmental condition allowing to contact with corrosive media such as carboxylic acids having a strong oxidative effect, the oxide film on the surface of copper alloy tube is vigorously eroded so that the corrosion protection by the oxide film is destroyed. In order to improve the corrosion resistant property against the ant-nest type corrosion compared to the ordinary phosphorous deoxidized copper, it is necessary to form more finer and less defect oxide film on the surface of tube. The present inventors found that such oxide film can be obtained by adding certain additive elements to copper alloy and then oxidizing the surface of these copper alloy materials.

The heat exchanger copper alloy tube according to the present invention has higher corrosion resistant property against the ant-nest type corrosion than the conventional phosphorous deoxidized copper tube being used for the heat exchanger and therefore very useful as a copper alloy tube for the heat exchanger used under the environment containing carboxylic acids easily causing the ant-nest type corrosion.

A fin-tube heat exchanger according to the present invention comprises: a main tube body including said copper alloy tube according to claim 1 or 2 and a plurality of plate type fins of aluminum or aluminum alloy placed in parallel each other on the outer surface of the main tube body. In this case, said copper alloy main tube body is preferably to be an internally grooved tube having a plurality of grooves provided in parallel each other on the inner surface thereof, the outer diameter of said copper alloy main tube is 4 to 25.4 mm, the ratio h/Di of the depth h of the groove to the inner diameter Di of the tube defined by the crest part between the grooves is $0.01 \leqq h/Di \leqq 0.05$, and the helix angle $\gamma$ is $0° \leqq \gamma \leqq 30°$.

Compared to the conventional heat exchanger using phosphorous deoxidized copper tube, the fin-tube heat exchanger according to the present invention is superior in the corrosion resistant property against the ant-nest type corrosion which easily occurred when affected by repeated deposit and evaporation of water and exposed to the peculiar environmental conditions of temperature/humidity and air-exchange, therefore it is very useful as the heat exchanger used under such environmental conditions.

Further, the fin-tube heat exchanger according to the present invention is different from the conventional phosphorous refined copper tube; since the copper tube containing elements inferior in the electric potential to Cu is used, the potential difference between the tubes and the fins (made of aluminum or aluminum alloy) can be reduced. Therefore, since the electric corrosion of the fins can be reduced, decrease of the thermal conductivity can be minimized during its use and the initial thermal conductivity can be maintained for a longer period.

A corrosion resistant copper alloy tube according to the present invention comprises; a main tube body containing at least one additive element having the standard enthalpy of −169 kJ for formation of an oxide at the amount within the range shown by the equation 1 below, and an oxide film formed on the surface of said main tube body in the thickness from 40 to 2000 Å by the heat treatment of the main tube body. The ratio Ix/Icu of the main peak intensity Ix of said additive element to the main peak intensity of Cu obtained by X-ray Electron Spectroscopy on the surface of said oxide film is 0.10 or greater.

$$0.04 \leqq \Sigma[Ax \cdot \ln(\Delta H^0 f(x)/(-169))] \leqq 4.2 \quad (1)$$

where, Ax is the content (atom %) of additive element x.

ln is natural logarithm.

$\Delta H^0 f(x)$ is the standard enthalpy (kJ/mol) for formation of oxide of additive element x.

$\Sigma$ is the sum of $Ax \cdot \ln(\Delta H^0 f(x)/(-169))$ for each additive element.

The corrosion resistant copper alloy tube according to the present invention, because the oxide film containing the pre-determined amount of certain additive elements is formed on the surface of main tube body, shows a superior corrosion resistant property against the ant-nest type corrosion which specifically occurs in the ordinary refrigerant tube or the heat exchanger tube consisting of phosphorous deoxidized copper tube; that is, the ant-nest type corrosion which may occur when affected by repeated deposit and evaporation of water and exposed to the peculiar environmental conditions of temperature/humidity and air-exchange, and capable of increasing its integrity and life span as the refrigerant tube or the heat exchanger tube, therefore the present invention is very useful.

DETAILED DESCRIPTION OF THE PREFERRED EMBODIMENTS

Figure 1:
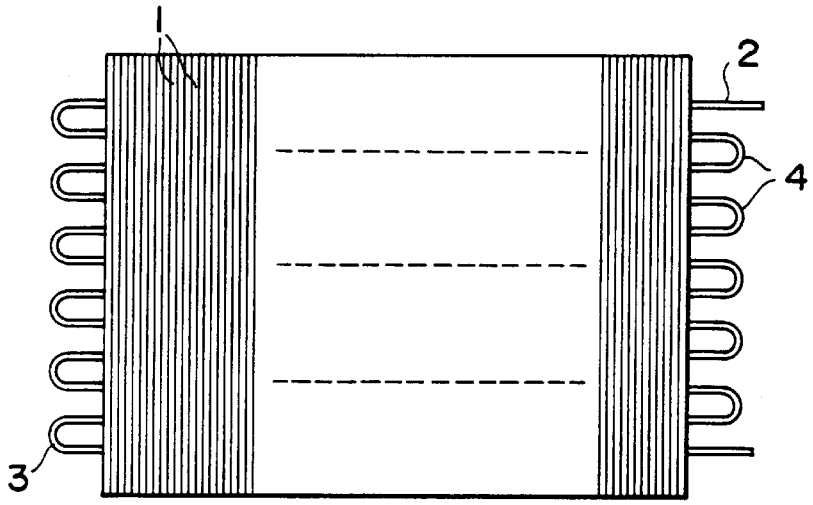
FIG. 1 is a plain view showing the fin-tube heat exchanger according to an embodiment of the present invention.

As a result of having conducted a series of diligent research to develop a copper alloy tube resistant to the ant-nest type corrosion, the present inventors found the followings.

That is, in the copper alloy containing the pre-determined amount of Mn and maintaining the oxygen content at the pre-determined level or less as described in the present invention, the corrosion resistant property is extremely improved compared to the conventional phosphorous deoxidized copper. Further, when at least one element from P or B is added to said copper alloy at the pre-determined amount, the brazing property is significantly improved compared to the conventional phosphorous deoxidized copper. The present invention was made based on these experimental results.

Then, the reason for addition of each component and for restriction of the composition will be fully explained.

Mn

The corrosion resistant property against the ant-nest type corrosion is improved by adding Mn. However, in case the Mn content is less than 0.05 wt. %, sufficient improvement effect of corrosion resistant property against the ant-nest type corrosion can not be achieved. The Mn content of 0.1 wt. % or more is preferable and by these contents further improvement can be observed. Meantime, if the Mn content exceeds 1.5 wt. %, resulting tube is not practically suitable because its resistance strength becomes higher so that bending property as tube decreases. Therefore, the Mn content should be within the range from 0.05 wt. % to 1.5 wt. %.

Oxygen Content

During the melting process of the copper alloy, inclusion of oxygen at certain level is unavoidable, but if oxygen exists in the base copper metal at the level exceeding 10 ppm, the hydrogen embrittlement may occur during the brazing process widely used for connecting of the copper tubes and resulting product is not yet strong enough for practical use. Therefore, the oxygen content is restricted to 100 ppm or less.

First Group Elements (P, B, Li, Pb, Sb)

All of P, B, Li, Pb and Sb are allowed to add as the deoxidation agent or as elements to improve the strength, but if total amount of these elements exceed 0.20 wt. %, the corrosion resistant improvement effect of Mn against the ant-nest type corrosion may decrease and the hot working property of the tube may decrease. Therefore, the amount to be added of each element belonging to the first group should be restricted to 0.20 wt. % or less in total.

Second Group Elements (Cr, Ti, Zr, Al, Si)

Cr, Ti, Zr, Al and Si are allowed to add in order to improve the strength and the heat resistance of the copper tube. However, if the content of these elements exceeds 0.50 wt. % in total, the brazing property may decrease, the bending property as tube may decrease due to increase of the proof stress and decrease of the expendability, and the corrosion resistant improvement effect of Mn against the ant-nest type corrosion may also decrease. Therefore, total amount to be added of each element belonging to the second group should be restricted to 0.50 wt. % or less.

Third Group Elements (Mg, Fe, Co, Ag, In, As)

Mg, Fe, Co, Ag, In and As can be added in order to improve the strength and the heat resistance of the copper tube, but if the content of these elements exceeds 1.0 wt. % in total, the bending property as tube may decrease due to increase of the proof stress and decrease of the expendability. Therefore, total amount to be added of each element belonging to the third group should be restricted to 1.0 wt. % or less.

Fourth Group Elements (Zn, Ni)

Zn and Ni are added in order to improve the strength and the corrosion resistant property of the copper tube, but if the amount to be added of these elements exceeds 5.0 wt. %, the bending property as tube may decrease due to increase of the proof stress and decrease of the expendability. Therefore, the amount to be added of each element belonging to the fourth group should be restricted to 5.0 wt. % or less.

P

P is usually added as a deoxidation agent during copper refining process or as the element to improve the strength of the copper alloy tube, but if P is added together with Mn, the brazing property of the copper alloy is improved further compared to the conventional phosphorous deoxidized copper.

At the heated state (at 700–900° C.) during the brazing process, P reduces Cu and Mn oxides so that P is effective to improve the brazing property. However, in the conventional phosphorous deoxidized copper, P on the copper surface is lost by sublimation due to high temperature during the brazing process and can not give sufficient reduction effect. However, in the copper alloy containing P and Mn, P concentrated on the copper surface forms reaction products with Mn added together which inhibit sublimation of P, resulting in sufficient exhibition of the reduction effect during the brazing process.

However, if the P content is less than 0.002 wt. %, sufficient improvement of the brazing property can not be achieved. Preferably, the P content is 0.005 wt. % or more so that further improvement of the brazing can be observed. On the other hand, if the P content exceeds 0.15 wt. %, the corrosion resistant property against the ant-nest type corrosion may decrease. Therefore, the P content should be restricted to the range from 0.002 wt. % to 0.15 wt. %. Further, if the Mn/P ratio is less than 2, the amount of P added is higher than the amount of Mn added and sufficient improvement effect against the ant-nest type corrosion can not be obtained. On the other hand, if the Mn/P ratio exceeds 100, the amount of P added is too lower than the amount of Mn added to obtain the improvement effect by Mn-phosphate compounds. Therefore, the Mn/P ratio should be restricted to the range from 2 to 100.

B

Similar to P as aforementioned, also B is generally used as a deoxidation agent or as an additive to improve the strength, but the brazing property may be improved by adding together with Mn. The effect of B in improvement of the brazing property is similar to the effect of P, B concentrated on the surface reacts with Mn to form borites so that sublimation of B may be inhibited and sufficient reduction effect of B may be obtained under high temperature during the brazing process.

However, if the B content is less than 0.002 wt. %, sufficient improvement effect of the brazing property can not be obtained. To obtain sufficient improvement effect of the brazing property the B content is preferably 0.005 wt. %. If the B content exceeds 0.15 wt. %, the corrosion resistant property against the ant-nest type corrosion may decrease. Therefore, the B content should be restricted to the range from 0.002 wt. % to 0.1 wt. %. Meantime, the Mn/B ratio is less than 2, the amount of B added is too high compared to the amount of Mn added to obtain sufficient effect of the corrosion resistant property against the ant-nest type corrosion. If the Mn/B ratio exceeds 100, the amount of B added is too low compared to the amount of Mn added to obtain sufficient improvement effect of the brazing. Therefore, the Mn/B ratio is restricted to the range from 2 to 100.

P and B

As aforementioned in the sections for P and B, P and B have similar effect against the brazing property and, if P and B are added together, improvement effect of the brazing property can be obtained. In this case, the ratio of Mn and P plus B; that is, Mn/(P+B) is preferably restricted to the range from 2 to 100.

Inevitable Impurities

In the present invention, Sn is an inevitable impurity. During the manufacturing process of the copper alloy tube, inclusion of Sn is unavoidable. If Sn exists in the copper alloy at the level of 0.01 wt. % or more, improvement in the corrosion resistant property of copper alloy tube by addition of Mn is deteriorated. Therefore, the inevitable impurity Sn is restricted to less than 0.01 wt. %.

As mentioned above, in the present invention, the copper alloy tube for the refrigerant tube or the heat exchanger having better corrosion resistant property against the ant-nest type corrosion than the conventional phosphorous deoxidized copper and further more practical and having better brazing, hot working and bending properties as tube can be obtained by adding Mn at the amount of said range and at the same time by controlling the oxygen content within said range and by restricting the content of each element shown in the first, second, third and fourth groups as well as the composition ratio of Mn and P and/or B within said range.

Then, the properties of the copper alloy according to the embodiment of the present invention will be fully explained comparing to the reference alloy.

The tube materials (O materials; 9.5 mm in outer diameter; 0.3 mm thick) listed in Tables 1 and 2 below were prepared by melt casting, hot extrusion, cold forging, and heat treatment processes, and the corrosion resistant against the ant-nest type corrosion, brazing, hair-pin bending, hot working and hydrogen embrittlement were evaluated.

The method used for evaluation of each property is shown below.

Corrosion Resistant Against the Ant-Nest Type Corrosion

Test pieces were exposed to the environment of formic acid and acetic acid as typical carboxylic acids, and the maximum corrosion depth was determined after corrosion. The test conditions ware as follows:

Corrosion medium:

100 ml of 1% aqueous solution of formic acid or 1% solution of acetic acid.

Exposure condition:

the test piece (100 mm long) was dipped into deionized water in a beaker which was placed in a one liter container containing said corrosion medium, then the container was sealed.

Temperature and Testing Period:

maintained at 40° C. for 20 days.

Brazing Property

Pre-determined amount of the phosphorous copper brazing filler metal (BCuP-2, 1.6 mm in diameter, 10 mm long) was placed on each test piece (half cut of the tube) and these test pieces were maintained at 850° C. under nitrogen stream for 10 minutes, then the length of diffused brazing filler metal was determined. The piece was a half cut of the tube with 300 mm long.

Hair-Pin Bending Property

The 180° bending test was carried out using a mandrel with 8.7 mm in diameter at the pitch of 25.4 mm, and the presence of wrinkling and broken-out in the bending part was observed.

Hot Working

Using test sample, 15 mm in diameter and 15 mm long, selected from the ingots, the drop hammer test with the deformation rate of 50% was carried out at 850° C., and the presence of cracks was determined.

Hydrogen Embrittlement

The test pieces were subjected to heat treatment at 850° C. under hydrogen stream for 30 minutes and then the cross section was observed for cracks by hydrogen embrittlement.

TABLE 1 (1)

| | | Compostion (Weight %) | | | Oxygen Content | Maximum Corrosion Length (mm) | | Brazing | Hair-pin Bending | Hot |
|---|---|---|---|---|---|---|---|---|---|---|
| | | Mn | P | Others | (ppm) | Formic Acid | Acetic Acid | Property | Property | Working |
| Example | A1 | 0.08 | ≦0.001 | ≦0.001 | 82 | 0.03 | 0.01 | ○ | ○ | ○ |
| | A2 | 0.12 | ≦0.001 | ≦0.001 | 70 | 0.02 | 0.01 | ○ | ○ | ○ |
| | A3 | 0.27 | ≦0.001 | ≦0.001 | 63 | 0.01 | — | ○ | ○ | ○ |
| | A4 | 1.02 | ≦0.001 | ≦0.001 | 55 | — | — | ○ | ○ | ○ |
| | A5 | 2.05 | ≦0.001 | ≦0.001 | 45 | — | — | ○ | ○ | ○ |
| | A6 | 1.05 | 0.12 | ≦0.001 | 35 | 0.01 | — | ○ | ○ | ○ |
| | A7 | 0.97 | 0.023 | B:0.10 | 30 | — | — | ○ | ○ | ○ |
| | A8 | 0.95 | 0.026 | Li:0.11 | 32 | 0.01 | — | ○ | ○ | ○ |
| | A9 | 1.08 | 0.025 | Pb:0.13 | 45 | 0.01 | — | ○ | ○ | ○ |

TABLE 1 (1)-continued

| | | Compostion (Weight %) | | | Oxygen Content | Maximum Corrosion Length (mm) | | Brazing | Hair-pin Bending | Hot |
|---|---|---|---|---|---|---|---|---|---|---|
| | | Mn | P | Others | (ppm) | Formic Acid | Acetic Acid | Property | Property | Working |
| | A10 | 1.10 | 0.027 | Sb:0.12 | 48 | 0.01 | — | ○ | ○ | ○ |
| | A11 | 1.05 | 0.024 | Cr:0.40 | 45 | — | — | ○ | ○ | ○ |
| | A12 | 1.00 | 0.024 | Ti:0.36 | 40 | 0.01 | — | ○ | ○ | ○ |
| | A13 | 1.03 | 0.022 | Zr:0.36 | 41 | 0.01 | — | ○ | ○ | ○ |
| | A14 | 1.05 | 0.023 | Al:0.37 | 40 | 0.01 | — | ○ | ○ | ○ |
| | A15 | 0.98 | 0.025 | Si:0.41 | 45 | — | — | ○ | ○ | ○ |
| | A16 | 1.01 | 0.027 | Mg:0.76 | 43 | 0.01 | — | ○ | ○ | ○ |
| | A17 | 0.95 | 0.027 | Fe:0.72 | 40 | — | — | ○ | ○ | ○ |
| | A18 | 0.97 | 0.026 | Co:0.70 | 42 | — | — | ○ | ○ | ○ |
| | A19 | 1.02 | 0.023 | Sn:0.75 | 45 | 0.01 | — | ○ | ○ | ○ |
| | A20 | 0.99 | 0.023 | Ag:0.74 | 44 | — | — | ○ | ○ | ○ |
| | A21 | 1.03 | 0.025 | In:0.72 | 46 | 0.01 | — | ○ | ○ | ○ |
| | A22 | 1.01 | 0.024 | As:0.68 | 50 | 0.01 | — | ○ | ○ | ○ |
| | A23 | 1.05 | 0.022 | Zn:3.05 | 45 | — | — | ○ | ○ | ○ |
| | A24 | 0.98 | 0.028 | Ni:3.02 | 42 | — | — | ○ | ○ | ○ |
| | A25 | 1.03 | 0.11 | Al:0.35<br>Sn:0.75<br>Zn:2.53 | 35 | 0.01 | — | ○ | ○ | ○ |
| | A26 | 1.05 | ≦0.001 | B:0.10<br>Cr:0.30<br>Ni:3.05 | 30 | — | — | ○ | ○ | ○ |
| | A27 | 1.00 | ≦0.001 | Li:0.12<br>Zr:0.35<br>Ag:0.72 | 38 | — | — | ○ | ○ | ○ |
| | A28 | 1.02 | 0.025 | Pb:0.10<br>Fe:0.73<br>In:0.70 | 45 | 0.01 | — | ○ | ○ | ○ |
| | A29 | 0.98 | 0.023 | Si:0.37<br>As:0.68 | 48 | 0.01 | — | ○ | ○ | ○ |
| | A30 | 1.02 | 0.022 | Ti:0.34<br>Co:0.75 | 55 | — | — | ○ | ○ | ○ |
| | A31 | 0.98 | 0.027 | Sb:0.10<br>Mg:0.70 | 53 | 0.01 | — | ○ | ○ | ○ |
| Compara-tive Example | A32 | <0.001 | 0.025 | ≦0.001 | 60 | 0.20 | 0.08 | ○ | ○ | ○ |
| | A33 | 0.025 | 0.024 | ≦0.001 | 56 | 0.18 | 0.07 | ○ | ○ | ○ |
| | A34 | 1.72 | ≦0.001 | ≦0.001 | 40 | — | — | Δ | Δ | ○ |
| | A35 | 0.12 | 0.001 | ≦0.001 | 125 | 0.05 | 0.02 | X | ○ | ○ |
| | A36 | 0.10 | 0.26 | ≦0.001 | 30 | 0.10 | 0.04 | ○ | ○ | X |
| | A37 | 0.09 | ≦0.001 | B:0.28 | 32 | 0.08 | 0.03 | ○ | Δ | X |
| | A38 | 0.12 | 0.001 | Li:0.24 | 43 | 0.08 | 0.03 | ○ | ○ | X |
| | A39 | 0.08 | 0.025 | Pb:0.27 | 50 | 0.10 | 0.04 | ○ | ○ | X |
| | A40 | 0.11 | 0.023 | Sb:0.25 | 52 | 0.09 | 0.03 | ○ | ○ | X |
| | A41 | 0.10 | 0.024 | Cr:0.68 | 45 | 0.03 | 0.01 | Δ | X | ○ |
| | A42 | 0.11 | 0.026 | Ti:0.65 | 50 | 0.05 | 0.02 | Δ | X | ○ |
| | A43 | 0.11 | 0.025 | Zr:0.70 | 55 | 0.05 | 0.02 | Δ | X | ○ |
| | A44 | 0.12 | 0.022 | Al:0.70 | 58 | 0.07 | 0.03 | Δ | Δ | ○ |
| | A45 | 0.10 | 0.021 | Si:0.65 | 52 | 0.06 | 0.02 | Δ | X | ○ |
| | A46 | 0.09 | 0.025 | Mg:1.25 | 51 | 0.05 | 0.02 | ○ | Δ | ○ |
| | A47 | 0.10 | 0.023 | Fe:1.28 | 48 | 0.10 | 0.03 | ○ | X | ○ |
| | A48 | 0.11 | 0.024 | Co:1.24 | 45 | 0.08 | 0.03 | ○ | X | ○ |
| | A49 | 0.11 | 0.027 | Sn:1.22 | 55 | 0.12 | 0.04 | ○ | Δ | ○ |
| | A50 | 0.10 | 0.028 | Ag:1.20 | 50 | 0.03 | 0.01 | ○ | Δ | ○ |
| | A51 | 0.12 | 0.020 | In:1.23 | 53 | 0.08 | 0.03 | ○ | Δ | ○ |
| | A52 | 0.12 | 0.026 | As:1.27 | 47 | 0.06 | 0.02 | ○ | X | Δ |
| | A53 | 0.13 | 0.023 | Zn:7.52 | 49 | 0.02 | 0.01 | ○ | Δ | ○ |
| | A54 | 0.10 | 0.025 | Ni:7.05 | 50 | 0.02 | 0.01 | ○ | Δ | ○ |

TABLE 2

| | | Compostion | | | Ratio | Oxygen Content | Maxinum Corrosion Length | Length of Wetted Area | Hair-pin Bending | Hydrogen |
|---|---|---|---|---|---|---|---|---|---|---|
| | | Mn | P | B | Mn/(P + B) | (ppm) | (mm) | (mm) | Property | Embrittlement |
| Example | A55 | 0.06 | 0.005 | <0.001 | 12 | 76 | 0.06 | 120 | ○ | ○ |
| | A56 | 0.10 | 0.025 | <0.001 | 4.0 | 32 | 0.05 | 130 | ○ | ○ |
| | A57 | 0.30 | 0.004 | <0.001 | 75 | 70 | 0.02 | 110 | ○ | ○ |
| | A58 | 0.33 | 0.015 | <0.001 | 22 | 55 | 0.03 | 120 | ○ | ○ |

TABLE 2-continued

| | | Compostion | | | Ratio | Oxygen Content | Maxinum Corrosion Length | Length of Wetted Area | Hair-pin Bending | Hydrogen |
|---|---|---|---|---|---|---|---|---|---|---|
| | | Mn | P | B | Mn/(P + B) | (ppm) | (mm) | (mm) | Property | Embrittlement |
| | A59 | 0.32 | 0.040 | <0.001 | 8.0 | 25 | 0.04 | 140 | ○ | ○ |
| | A60 | 0.96 | 0.012 | <0.001 | 80 | 46 | — | 100 | ○ | ○ |
| | A61 | 1.05 | 0.030 | <0.001 | 35 | 30 | — | 110 | ○ | ○ |
| | A62 | 1.21 | 0.120 | <0.001 | 10 | 16 | 0.03 | 130 | ○ | ○ |
| | A63 | 0.032 | <0.001 | 0.005 | 64 | 60 | 0.01 | 110 | ○ | ○ |
| | A64 | 0.31 | <0.001 | 0.020 | 16 | 40 | 0.02 | 130 | ○ | ○ |
| | A65 | 0.28 | <0.001 | 0.050 | 5.6 | 30 | 0.03 | 150 | ○ | ○ |
| | A66 | 0.30 | 0.005 | 0.005 | 30 | 56 | 0.02 | 120 | ○ | ○ |
| | A67 | 0.32 | 0.020 | 0.020 | 8.0 | 28 | 0.03 | 140 | ○ | ○ |
| Comparative | A68 | <0.001 | 0.025 | <0.001 | — | 45 | 0.20 | 100 | ○ | ○ |
| Example | A69 | 0.02 | 0.005 | <0.001 | 4.0 | 80 | 0.15 | 100 | ○ | ○ |
| | A70 | 2.04 | 0.040 | <0.001 | 51 | 23 | 0.01 | 60 | X | ○ |
| | A71 | 2.04 | 0.040 | <0.001 | 80 | 85 | 0.04 | 80 | ○ | ○ |
| | A72 | 1.08 | 0.205 | <0.001 | 5.3 | 15 | 0.14 | 130 | Δ | ○ |
| | A73 | 0.10 | 0.100 | <0.001 | 1.0 | 33 | 0.25 | 130 | ○ | ○ |
| | A74 | 1.00 | 0.005 | <0.001 | 200 | 42 | — | 50 | ○ | ○ |
| | A75 | <0.001 | <0.001 | 0.020 | — | 48 | 0.18 | 100 | ○ | ○ |
| | A76 | 0.06 | <0.001 | 0.001 | 60 | 90 | 0.05 | 80 | ○ | ○ |
| | A77 | 1.05 | <0.001 | 0.182 | 5.8 | 20 | 0.16 | 130 | Δ | ○ |
| | A78 | 0.10 | <0.001 | 0.090 | 1.1 | 38 | 0.23 | 130 | ○ | ○ |
| | A79 | 0.96 | <0.001 | 0.006 | 160 | 47 | — | 60 | ○ | ○ |
| | A80 | 0.12 | 0.060 | 0.035 | 1.3 | 31 | 0.24 | 120 | ○ | ○ |
| | A81 | 1.02 | 0.005 | 0.003 | 130 | 44 | — | 70 | ○ | ○ |
| | A82 | 0.30 | 0.015 | <0.001 | 20 | 150 | 0.03 | 130 | ○ | X |

In Table 1, "—" under the heading of "maximum corrosion length" stands for "no corrosion". Under the heading of "brazing property", "○" stands for "good wettability of brazing filler metal", "Δ" for "poor wettability of brazing filler metal", "X" for "presence of hydrogen embrittlement". Under the heading of "hair-pin bending property", "○" stands for "good bending", "Δ" for "presence of wrinkling" and "X" for "presence of broken-out". Under the heading of "hot working", "○" stands for "good" and "X" for "presence of cracks".

As obvious from Table 1, all examples No.A1 through No. A31 of the present invention have better corrosion resistant property against the ant-nest type corrosion than the phosphorous deoxidized copper tube (comparative example No. A32); the example No.A1 (Mn:0.08 wt. %) showed the maximum corrosion depth equivalent to about 1/7 of that of the phosphorous deoxidized copper tube, and no evidence of corrosion was observed in the example No.A4 (Mn: 1.02 wt. %); the corrosion resistant property was further improved according to increase of the Mn content.

Furthermore, the examples No.A6 through No.A31 containing the pre-determined amount of the element(s) listed in either first, second, third or fourth group showed better corrosion resistant property equivalent to those not containing any element listed in the first, second, third and fourth groups and any practical problem could be seen since all brazing, hair-pin bending and hot working properties were good.

On the other hand, the comparative example No.A33, since the Mn content is lower, showed insufficient corrosion resistant improvement effect against the ant-nest type corrosion. On the contrary, the comparative example No. A34, since the Mn content is too high, showed sufficient corrosion resistant property against the ant-nest type corrosion but poor brazing and hair-pin bending properties so that may not practically useful. Further, the comparative example No. A35 also is not suitable for practical use because the corrosion resistant improvement effect of added Mn against the ant-nest type corrosion decreased and the hydrogen embrittlement occurred due to high oxygen level.

Furthermore, the comparative examples No.A36 through No.A54 contains the pre-determined amount of single element listed in the first, second, third and fourth groups. However, the comparative examples No.A36 through No.A40 are not suitable for practical use mainly due to poor performance in the hot working. The comparative examples No.A41 through No.A45 are not practical mainly due to decrease of brazing property. The comparative examples No.A46 through No.A52, No.A53 and No.A54 are not suitable for practical use mainly because the hair-pin bending property became poor due to increase of the proof stress and decrease of the expendability.

In Table 2, "—" under the heading of "maximum corrosion length" stands for "no corrosion". Under the heading of "hair-pin bending", "○" stands for "good bending", "Δ" for presence of wrinkling" and "X" for "presence of broken-out". Under the heading of "hydrogen embrittlement", "○" stands for "good" and "X" for "presence of cracks".

As obvious from Table 2, the examples No.A55 through No.A67 showed superior corrosion resistant property against the ant-nest type corrosion to the comparative examples No.A68 of phosphorous deoxidized copper tube. Further, the example No.A55 showed the maximum corrosion depth equivalent to about 1/3 of that of the phosphorous refined copper tube and no evidence of corrosion could be seen in the examples No.A60 and No.A61, indicating that the corrosion resistant property is improved according to increase of the Mn content. Furthermore, the examples No.A55 through No.A67 showed improvement in the length of the area wetted by the brazing filler metal compared to the comparative example No.A14 of phosphorous deoxided copper tube, indicating that these are all epoch-making materials capable of improving both corrosion resistant property against the ant-nest type corrosion and brazing property at same time. Further, these examples No.A1 through No.A31 and No.A55 through No.A67 are all good in the hair-pin bending and hydrogen embrittlement and have no problem in practical use.

On the other hand, the comparative example No.A69 is not suitable for practical use because the corrosion resistant improvement effect of Mn is not sufficient due to low content of Mn, and the comparative example alloys are not suitable for practical use because the Mn content is too high so that, even though the corrosion resistant property is sufficient, but both diffusion of the brazing filler metal and the hair-pin bending properties are not satisfactory. Also, the comparative examples No.A71 and No.A76 showed only limited diffusion of the brazing filler metal due to lower content of B or P, and the comparative examples No.A72 and No.A77 showed lower corrosion resistant property against the ant-nest type corrosion due to higher content of P or B.

Further, the comparative examples No.A73, A78 and A80 showed lower corrosion resistant property due to lower Mn/(P+B) ratio, and the comparative examples No. A74, A79 and A81 showed lower wettability of the brazing filler metal due to higher Mn/(P+B) ratio. Furthermore, the comparative example No.A82 is not suitable for practical use because the hydrogen embrittlement occurred due to excess oxygen content.

Next, a corrosion resistant copper alloy tube for the heat exchanger according to another embodiment will be fully described, particularly focusing on the rationale for restriction of the values of the volume ratio of the oxide of added element to the base metal, the amount of element to be added, the thickness of the oxide film and the electric potential of the oxide film.

Volume Ratio of Oxide

The micro-structure of oxide film varies by the volume ratio $\phi$ of oxide formed on the surface thereof to Cu base metal (ratio of the molecular volume of the oxide to atomic volume of Cu base metal), which affects on the corrosion resistant property.

Said volume ratio of oxide can be expressed by the following equation (2).

$$\phi = Md/nmD \quad (2)$$

where, M is the molecular weight of oxide, D is the specific gravity of oxide, m is the molecular weight of base metal, d is the specific gravity of base metal, n is number of metal atoms contained in one molecule of oxide.

If this volume ratio is 1.0 or less, since the volume of oxide is lower than that of base metal, an oxide film formed on the surface of base metal becomes porous which allows the corrosion medium to contact with the surface of base metal so that the corrosion resistant property decreases. In case of the conventional phosphorous deoxidized copper, the volume ratio of oxide film ($Cu_2O$) formed on the surface is about 1.7. In order to prevent the ant-nest type corrosion, the volume ratio of oxide film on the surface of copper alloy is to be 1.7 or more. If the volume ratio exceeds 3.0, difference between the molecular volume of oxide film and the atomic volume of base metal becomes too large which may create some distortion of the oxide film and consequently defects such as cracks may occur. In this case, the corrosion resistant property may decrease as the case of porous oxide film. Therefore, the volume ratio of oxide should be restricted to the range from 1.7 to 3.0. The elements such as Mn, Fe, Co and Cr can be used to form such oxides.

Amount to be Added

If the amount of additive element to be added to the copper alloy is less than 0.05 wt. %, the volume ratio of Cu oxide from the base metal against the oxide of additive element in the oxide film becomes significantly high, resulting in decrease of the corrosion resistant property. On the other hand, if the added amount of additive element exceeds 3 wt. %, the probability of poor wettability of the brazing filler metal becomes high due to strong oxide formed from the additive element during the brazing process as one of fabrication processes of the heat exchanger, therefore there is a danger of generating leakage in the brazed part during the pressure test. Therefore, the amount of additive element to be added into the copper alloy should be restricted to the range from 0.05 to 3 wt. %.

Thickness of Oxide Film

If the thickness of oxide film formed on the surface of tube is less than 30 Å, Cu erosion by carboxylic acids may occur through the Cu oxide film and the corrosion medium easily contacts with the surface of base metal, resulting in decrease of the corrosion resistant property. If the thickness of said oxide film exceeds 3000 Å, the brazing filler metal may poorly wet or spread out on the brazing part, therefore there is a danger of generating leakage in the brazed part. Therefore, the thickness of oxide film should be restricted to the range from 30 to 3000 Å.

Electric Potential of Oxide Film

If the potential difference between the main body of tube and the oxide film is large and there is a defect in the oxide film, the potential difference between the oxide of additive element and Cu oxide existing in the oxide film or between these oxides and the main body of tube may create the cell reaction, and consequently the corrosion may be enhanced. The corrosion may also be enhanced if the additive element has already deposited in the Cu base metal. In order to reduce the corrosion by the cell reaction as aforementioned, the natural electric potential of the oxide film is to be within the range of from 0.2 V to −0.2 V against the phosphorous deoxidized copper having oxide film of the same thickness (30 to 3000 Å). In this case, the natural electric potential of the oxide film is determined after a tube provided with the oxide film was dipped into formic acid solution of 0.1 v. % at room temperature (20 to 30° C.) for 24 hours, for example. If the natural electric potential of the oxide film is less than −0.2 V against the phosphorous deoxidized copper, the oxide formed from the additive element may easily dissolve into carboxylic acids. On the contrary, the natural electric potential of the oxide film exceeds +0.2 V against the phosphorous deoxidized copper, the corrosion resistant property of the Cu base metal in the copper alloy is deteriorated. Therefore, the differential of natural electric potential between the oxide film and the phosphorous deoxidized copper in said formic acid solution should be restricted to the range of from 0.2 V to −0.2 V.

Further, addition of P as the deoxidation agent into said copper alloy does not affect on the aforementioned effects. Addition of Pb into said copper alloy also does not affect on the aforementioned effects.

Then, various copper alloy tubes for the heat exchanger according to the examples of the present invention were actually manufactured and their corrosion resistant property was compared to the comparative examples as follows.

The copper alloy tubes containing the additive element at the amount listed in Table 3 below and balanced with Cu and other unavoidable impurities were manufactured. The dimensions of each tube were as follows: 9.52 mm in outer diameter and 0.36 mm thick. The comparative example B12 was the ordinary phosphorous deoxidized copper tube.

These tubes were subjected to the heat treatment under $N_2$ atmosphere containing 100 ppm of $O_2$ and 5% of $H_2$ to form the oxide film of 30 to 3000 Å thick on the surface thereof. natural electric potential of the oxide film on the surface of the copper alloy tube was determined. From this value and the natural electric potential of the phosphorous deoxided copper determined under similar conditions, the differential potential was calculated.

Furthermore, using each tube of the examples and the comparative examples, the finned coil was fabricated, the return-bending part was brazed, then the brazing property of each tube of the examples and the comparative examples was evaluated. The brazing was carried out using BCuP-2 as the brazing filler metal, at 850 ° C. for 30 seconds. The air-tightness test was carried out at the air pressure of 2.94 MPa for each tube after brazing to evaluate the brazing property based on presence or absence of leakage. These results are shown all together in Table 3. Under the heading of "brazing property", "○" stands for "no leakage" and "X" for "presence of leakage".

TABLE 3

| | | P content (wt %) | Additive Elements (wt %) | Maximum Corrossion Length (mm) 1% Formic Acid | 1% Acetic Acid | Brazing Property | Electrical Potential Difference (V) |
|---|---|---|---|---|---|---|---|
| Example | B1 | 0.023 | Mn:0.08 | 0.01 | — | ○ | −0.01 |
| | B2 | 0.025 | Mn:0.12 | 0.01 | — | ○ | −0.02 |
| | B3 | 0.021 | Mn:1.31 | — | — | ○ | −0.02 |
| | B4 | 0.031 | Mn:2.60 | — | — | ○ | −0.05 |
| | B5 | 0.024 | Mn:1.75 Fe:1.20 | — | — | ○ | 0.10 |
| | B6 | 0.031 | Mn:0.72 Pb:2.42 | — | — | ○ | −0.12 |
| | B7 | 0.035 | Co:0.75 | 0.01 | — | ○ | −0.05 |
| | B8 | 0.027 | Cr:0.91 | 0.01 | — | ○ | −0.09 |
| | B9 | 0.028 | Fe:0.52 | 0.01 | — | ○ | −0.11 |
| | B10 | — | Mn:0.32 | 0.01 | — | ○ | −0.02 |
| | B11 | — | Mn:2.00 | — | — | ○ | −0.03 |
| Comparative Example | B12 | 0.022 | — | 0.26 | 0.17 | ○ | 0 |
| | B13 | 0.024 | Mn:0.02 | 0.15 | 0.08 | X | −0.01 |
| | B14 | 0.019 | Mn:3.14 | — | — | ○ | −0.13 |
| | B15 | 0.021 | Pb:0.02 | 0.17 | 0.12 | ○ | −0.20 |
| | B16 | 0.026 | Sn:1.76 | 0.14 | 0.11 | ○ | −0.31 |
| | B17 | 0.030 | Mg:0.06 | 0.24 | 0.16 | ○ | −0.02 |

The volume ratio of the oxide of additive element (PbO) in the comparative example B15 was 1.40, that of the oxide of the additive element (SnO) in the comparative example B16 was 1.31, that of the oxide of the additive element (MgO) in the comparative example B17 was 0.85, and that of oxide of the additive element in each of the examples B1 through B9, and the comparative examples B13 and B14 was established in the range from 1.7 to 3.0.

These copper alloy tubes of the examples or the comparative examples were exposed to the atmosphere affected by 1 v. % of formic acid solution or acetic acid solution for 20 days, then the maximum corrosion depth was determined to evaluate the corrosion resistant property. Exposure to formic acid or acetic acid was used because the ant-nest type corrosion can be readily reproduced by formic acid and acetic acid.

Further, each copper alloy tube was dipped into 0.1 v. % of formic acid solution at 256, 36° C. for 24 hours, then the As obvious from Table 3, in case 1 v. % formic acid solution was used as the corrosion medium, only corrosion with about 0.01 mm depth was observed in the examples B1 through B11, indicating better corrosion resistant property. In these examples B1 through B11, the brazing property was also good. On the other hand, the conventional phosphorous deoxidized copper of the comparative example B12, the comparative example B13 which contains only small amount of the additive element, and comparative examples B15, B16 and B17 which have small volume ratio of the oxide were all inferior to the examples in the corrosion resistant property. The comparative example B14 which has large amount of the additive element showed poor brazing property.

Next, a fin-tube heat exchanger according to another embodiment will be explained. In the fin-tube heat exchanger according to the present embodiment, a plurality of plate type fins of aluminum or aluminum alloy are placed in parallel each other on the outer surface of the main tube body of claim 1 or 2.

An internally grooved tube is preferred as the copper alloy tube used for the fin-tube heat exchanger according to the present invention. This internally grooved tube, 4 to 25.4 mm in outer diameter, having a plurality of internal grooves parallel each other, is constructed so as to satisfy the following relationships:

$$0.01 \leqq h/Di \leqq 0.05 \text{ and } 0° \leqq \gamma \leqq 30°$$

where, h is the depth of groove, Di is minimum internal diameter (determined at the crest part), and is helix angle toward the tube axis. Thereby, the heat transfer capacity can be significantly improved.

If the outer diameter of the internally grooved tube is less than 4 mm, the pressure loss of the thermal medium may increase and sufficient heat transfer capacity can not be obtained. On the other hand, if the outer diameter exceeds 25.4 mm, the heat exchanger becomes large size and uneconomical as the fin-tube heat exchanger. Therefore, the outer diameter of tube should be restricted to the range from 4 to 25.4 mm.

If the ratio h/Di is less than 0.01, improvement of heat transfer capacity is not sufficient. On the contrary, if the ratio h/Di exceeds 0.05, the pressure loss increases so that the heat transfer capacity may decrease. Further, if the helix angle γ toward the tube axis exceeds 30°, the pressure loss increases and sufficient heat transfer capacity can not be obtained. Therefore, the ratio h/Di is preferably within the range from $0.01 \leqq h/Di \leqq$ to 0.05, and the helix angle γ within the range from 0° to 30°.

When the internally grooved tube having internally formed grooves with such construction is used as the tube, the fin-tube heat exchanger having better corrosion resistant property against the ant-nest type corrosion and further having better heat transfer capacity as the heat exchanger can be obtained.

Further, the copper alloy tube constituting the tube according to the present invention may contain unavoidable impurities such as P and B which are usually used as deoxidation agents in addition to Zn, Mn and Mg, but existence of such impurities does not cause any problem for improvement of the corrosion resistant property.

Figure 2:
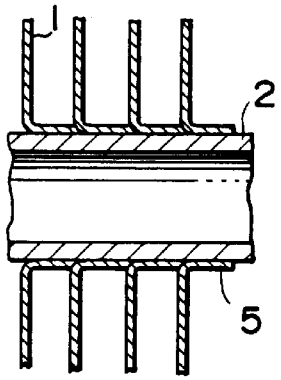
FIG. 2 is a sectional view in the direction of the tube axis of the same.
Figure 3:
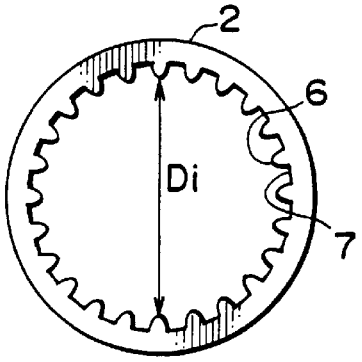
FIG. 3 is a sectional view of the tube thereof.
Figure 4:
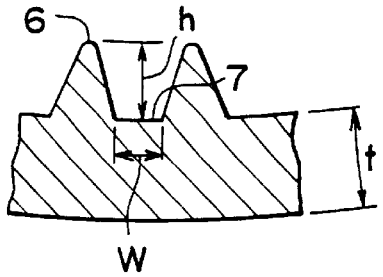
FIG. 4 is a enlarged sectional view of a part of the tube thereof.

Then, the examples of the present invention will be explained comparing to the comparative examples. The fin-tube heat exchanger shown in FIG. 4 were prepared using the tubes (annealed) having the composition listed in Table 4 below, the corrosion resistant property, the heat transfer capacity, the essential characteristics such as working and brazing properties required for manufacturing were evaluated. FIG. 2 is a view of this fin-tube heat exchanger sectioned toward the tube axis, FIG. 3 is a sectional view of the tube, and FIG. 4 is a partially enlarged view of the tube. Each fin 1 is substantially a plate having a plurality of tube insertion holes formed in between the top and the bottom thereof, and to the surrounding edge of each insertion hole is provided with a tube type fin collar 5 in the way that the axis direction thereof is orthogonal to the fin 1. All plate type fins 1 are placed in parallel each other, and a tube 2 is inserted into the fin collar 5 of each fin 1. This tube 2 is formed in U-shape with a hair-pin bending part 3 to connect each tube into one line of tube; that is, each tube 2 is inserted into the fin collar 5 and fixed to the fin 1 by expanding the tube 2, then both ends of the tube 2 are connected to the end of neighboring tubes 2 through a semi-circular tube 4 by brazing.

Each tube 2 is provided with a plurality of grooves 7 on the internal surface thereof, and these grooves 7 spirally extends inside the tube 2. The internal diameter Di of the tube 2 is defined as the distance between a crest 6 of the groove 7 and the opposed crest 6, representing the minimum internal diameter.

The internally grooved tube used in the fin-tube heat exchanger of the present example has the following dimensions: the outer diameter=7 mm, the inner diameter (Di)=6.14 mm , 50 grooves at the sectioned surface orthogonally to the tube axis, the groove depth (h)=0.18 mm, the bottom thickness (t)=0.25 mm, the bottom width of groove (W)=0.23 mm, and the helix angle γ of groove against the tube axis=18°. The composition of copper alloy for each tube 2 is shown in Table 4 below.

Volatile lubricant oil was used in each step of blanking of the fin, hair-pin bending and expansion of the tube during manufacturing of the fin-tube heat exchanger, but subsequent degreassing step by solvent was eliminated. The brazing of the tube was carried out using the phosphorous copper brazing filler metal (BCuP-2; the species defined by JIS-Z3264 and containing 6.8–7.5% of P, 0.2% of other elements and the remaining is mainly Cu) by the burner brazing. Results of evaluation of each characteristic are shown in Table 5 below. The heat transfer calorie shown in Table 5 was obtained under air blowing at 1.0 m/sec.

TABLE 4

| | Composition (wt %) | | | | |
|---|---|---|---|---|---|
| | Zn | Mn | Mg | P | Cu |
| Example | | | | | |
| C1 | 0.5 | — | — | — | balance |
| C2 | 5.0 | — | — | — | balance |
| C3 | — | 0.5 | — | — | balance |
| C4 | — | 2.0 | — | — | balance |
| C5 | — | — | 0.5 | — | balance |
| C6 | — | — | 2.0 | — | balance |
| C7 | 5.0 | 1.0 | 1.0 | — | balance |
| Comparative Example | | | | | |
| C8 | — | — | — | 0.03 | balance |
| C9 | 15 | — | — | — | balance |
| C10 | — | 10 | — | — | balance |
| C11 | — | — | 10 | — | balance |

TABLE 5

| | | Corrosion Resistant Property Maximum Corrosion Depth | Heat Transfer Capacity Heat Transfer Calorie (kcal/h) | | Working Wrinkling by Hair-pin | Brazing Property Broken-out | |
|---|---|---|---|---|---|---|---|
| | | (mm) | Evaporation | Condensation | Bending | Part | Valuation |
| Example | 1 | 0.03 | 1300 | 2200 | small | tube | ○ |
| | 2 | 0.02 | 1298 | 2196 | | | ○ |
| | 3 | 0.02 | 1299 | 2198 | | | ○ |
| | 4 | 0.01 | 1294 | 2190 | | | ○ |
| | 5 | 0.03 | 1299 | 2198 | | | ○ |
| | 6 | 0.02 | 1296 | 2192 | | | ○ |
| | 7 | 0.01 | 1290 | 2182 | | | ○ |
| Comparative | 8 | 0.20 | 1300 | 2200 | small | tube | Δ |
| | 9 | 0.01 | 1270 | 2153 | large | brazed part | X |
| | 10 | 0.01 | 1275 | 2156 | | | X |
| | 11 | 0.10 | 1272 | 2154 | | | X |

Each characteristic listed in Table 5 was evaluated according to the following method.

Corrosion Resistant Property Against the Ant-Nest Type Corrosion

The fin-tube heat exchanger used each tube having composition listed in Table 4 was operated inside room under the following conditions and then the maximum corrosion depth by the ant-nest type corrosion was determined.

Operation Environment:

'temperature 30° C., relative humidity 80%

Operation Conditions:

5-minute cooling and 10-minute air blowing, repeated for 6 months.

Heat Transfer Capacity

Using a wind tunnel test apparatus, the heat transfer calorie (evaporation and condensation) as the heat exchanger was determined.

R-22 (Fleon HCFC-22: molecular formula $CHClF_2$) was used as a refrigerant, and measurement conditions were as follows.

Evaporation Test

Air: Dry-bulb/wet-bulb temperature 27.0° C./19.0° C.

Refrigerant: Out-put pressure from heat exchanger 5.4 $kgf/cm^2$

Overheating: 5.0 deg

Condensation Test

Air: Dry-bulb/wet-bulb temperature 20.0° C./15.0° C.

Refrigerant: Out-put pressure from heat exchanger 18.8 $kgf/cm^2$

Undercooling: 5.0 deg

Characteristics Required for Production

Working (hair-pin bending: 10.5 mm in diameter):

observed for incidence of wrinkling inside the bending part.

Brazing Property:

the breaking test was carried out under adding internal pressure to the tube of heat exchanger and then broken-out part was observed.

As obvious from Table 5, the examples C1 to C7 of the present invention all showed better corrosion resistant property against the ant-nest type corrosion than the comparative example C8 using the conventional phosphorous deoxidized copper and other characteristics such as the heat transfer capacity required as the heat exchanger and the working and brazing properties required for manufacturing were good and almost equal to the comparative example C8 using the conventional phosphorous deoxidized copper.

On the other hand, the comparative examples C9 to C11 were not suitable for practical use because heat transfer capacity as well as the working and brazing properties decreased due to use of the tubes containing large amount of Zn, Mn and Mg. The comparative example C11 showed inferior corrosion resistant property, probably due to deposit of Mg since the Mg content was too high and exceeded its solid soluble volume against Cu.

Next, a corrosion resistant copper alloy tubes according to another embodiment will be described.

As a result of having conducted a series of diligent research to improve the corrosion resistant property of copper alloy tube, the present inventors found that the corrosion resistant property against the ant-nest type corrosion can be significantly improved by providing on the surface of the main body of tube a oxide film containing oxide of an element having smaller standard enthalpy for formation of the oxide than that (−169 kj/mol at 298.15 K Kelvin temperature) for Cu oxide ($Cu_2O$). Such oxide film can be formed by annealing the main body of tube consisted of one or two additive elements having standard enthalpy −169 kJ/mol or less for formation of the oxide, Cu and unavoidable impurities in the inactive atmosphere or in the atmosphere containing small amount of oxygen, for example.

In this case, if the thickness of oxide film is less than 40 Å, sufficient improvement effect of the corrosion resistant property can not be obtained. On the other hand, if the thickness of said oxide film exceeds 2000 Å, further increase of effect can not be expected due to saturation of improvement effect of the corrosion resistant property and also the brazing property may decrease. Therefore, the thickness of oxide film should be restricted to the range from 40 to 2000 Å.

Among said additive elements, elements having smaller standard enthalpy for formation of oxide have larger improvement effect of the corrosion resistant property. For said additive elements, the corrosion resistant property increases by increasing the content. However, if the content of said additive element exceeds certain level, the working property of copper alloy tube may significantly decrease. Therefore, the lower limit of content for the additive element should be restricted based on the corrosion resistant property and the upper limit should be restricted based on the working property. As a result of a series of diligent research, the present inventors found that the oxide film having better corrosion resistant property against the ant-nest type corrosion can be obtained by restricting the amount of additive element to the range expressed by the following equation (3).

$$0.04 \leqq \Sigma[Ax \cdot \ln(\Delta H^{0}f(x)/(-169))] \leqq 4.2 \quad (3)$$

where, Ax is the content of additive element x in atomic %.

ln is natural logarithm.

$\Delta H^{0}f(x)$ is standard enthalpy for formation of oxide of additive element in kJ/mol.

$\Sigma$ is sum of $Ax \cdot \ln(\Delta H^{0}f(x)/(-169))$ for each additive element.

That is, the corrosion resistant property created by the oxide film relates to both standard enthalpy for formation of oxide and the content of additive element, and the value obtained from the following equation 4 can be used as the index for the corrosion resistant property.

$$[Ax \cdot \ln(\Delta H^{0}f(x)/(-169))] \quad (4)$$

So, if the copper alloy tube contains the element having larger oxygen affinity than that of Cu (that is, the element having smaller standard enthalpy for formation of oxide), the oxide film on the surface of copper alloy tube mainly contains the oxide of that additive element. In general, there exists absorbed water on the surface of oxide as hydroxide radical, and there is a trend toward that the oxide having smaller standard enthalpy for formation contains larger amount of absorbed water. Therefore, if the standard enthalpy for formation of oxide of additive element is expressed by $\Delta H^{0}f(x)$, it can be said that the alloy containing the element having larger ratio $[\Delta H^{0}f(x)/(-169)]$ for the standard enthalpy for formation of oxide against the standard enthalpy (−169 kJ/mol) for formation of Cu oxide ($Cu_2O$) is covered on its surface by larger amount of hydroxide radical than pure copper. In the alloy covered on its surface by larger amount of hydroxide radical, even if dew drops formed on its surface, they diffuses to form water film so that its surface is maintained in uniform sate and the ant-nest type corrosion is hardly formed. That is, the value of the aforementioned equation (4) can be used as the index for the corrosion resistant property against the ant-nest type corrosion. Furthermore, if the content of these additive elements is increased, its effect becomes more remarkable, but the present inventors found that there is a relationship between the content Ax and $[\Delta H^{0}f(x)/(-169)]$ and that improvement effect of the corrosion resistant property can be evaluated by the product of the natural logarithm of $[\Delta H^{0}f(x)/-169]$ by Ax; that is, $Ax \cdot \ln(\Delta H^{0}f(x)/(-169))$ and further that the value of $Ax \cdot \ln(\Delta H^{0}f(x)/(-169))$ is additive property in case of the alloy containing two or more additive elements.

Therefore, in case of the alloy containing a plurality of elements, the value obtained for each element from the equation (4) should be summed. That is, the following equation (5) can be applied.

$$\Sigma[Ax \cdot \ln(\Delta H^{0}f(x)/(-169))] \quad (5)$$

If the value obtained from this equation (5) is less than 0.04, sufficient improvement effect can not be created by the oxide film. And, if the value obtained from the equation (5) exceeds 4.2, further improvement of the corrosion resistant property can not be expected due to saturation of improvement effect of the corrosion resistant property and the working property of the copper alloy tube is decreased by the additive element. Therefore, the content of additive element should be restricted to the range shown by the aforementioned equation (3).

Further, the characteristics of the oxide film formed on the surface of tube can be readily judged based on intensity of the main peak from the X-ray electron spectroscopy (XPS) analysis. That is, when the ratio Ix/ICu of said main peak intensity Ix of said additive element to the main peak intensity ICu of Cu is 0.10 or grater, significant improvement effect of the corrosion resistant property against the ant-nest type corrosion can be obtained. Then, the ratio of the main peak intensity Ix for the additive element to the main peak intensity ICu of Cu will be explained in more detail.

It is well known that the corrosion resistant property of the copper alloy largely depends not only on its alloy composition also on the film formed on the surface. In the present invention, better corrosion resistant property can be obtained by restricting not only the thickness of the oxide film formed on the surface also restricting the element constructing the oxide film. In order to increase the effect further of the alloy containing the element having small standard enthalpy for formation of oxide, the oxide film formed on the surface thereof should contain the additive element concentrated at higher level than the alloy composition ratio of the main body of tube, and in order to obtain that index the XPS analysis is most practical from technical and economical point of view. As a result of a series of diligent research on the relationship between said ratio Ix/ICu and the corrosion resistant property, the present inventors found that if the ratio Ix/ICu is 0.10 or more, improvement effect of the corrosion resistant property significantly increases. The main peak ratio Ix/ICu can be established at 0.10 or more, for example, by controlling the composition rate of reduction gas such as oxygen, CO and the like in the atmosphere in the annealing process for treating the copper alloy tube mild, but not restricted thereto.

Then, comparing to the comparative examples, the examples of the present invention will be explained.

First, the tube materials (O materials: 9.5 mm in outer diameter: 0.3 mm thick) having composition shown in Table 6 below were prepared by the melt casting, the hot extrusion, the cold forging and the heat treatment. The figures shown under the heading of "the symbol of an element" indicates the standard enthalpy in kJ/mol for formation of oxide of that element at the temperature of 298.15 K. The value calculated from the equation 5 (under the heading of Σ[ ]) for each copper alloy tube or copper tube of these examples and the comparative examples, the thickness of the oxide film and the main peak intensity ratio Ix/ICu are also shown in Table 6. The thickness of the oxide film was obtained from the etching time by Auger Electron Spectroscopy (AES) analysis. The main peak intensity by the XPS analysis was determined using X-ray (Kα) derived from Mg under the following conditions: output power 300 W (voltage 15 kV, current 20 mA), analyzed area 1000 $\mu m^2$.

TABLE 6

| | | Composition (atomic %) | | | | | | | Thickness of Oxide Film (Å) | Ix/ICu |
|---|---|---|---|---|---|---|---|---|---|---|
| | | Cu -169 | Zn -348 | Mn -520 | Sn -581 | Co -238 | Ag -31 | Σ [ ] | | |
| Example | D1 | balance | 0.42 | — | — | — | — | 0.30 | 800 | 0.35 |
| | D2 | | 1.10 | 0.19 | — | — | — | 1.01 | 1300 | 0.44 |
| | D3 | | 0.33 | — | 0.41 | — | — | 0.74 | 1100 | 0.22 |
| | D4 | | — | 0.04 | 2.60 | — | — | 3.25 | 1500 | 0.90 |
| | D5 | | 1.21 | — | — | 0.71 | — | 1.12 | 600 | 0.31 |
| | D6 | | — | — | 1.30 | — | — | 1.61 | 400 | 0.18 |
| | D7 | | — | 0.20 | — | — | — | 0.22 | 400 | 0.20 |
| | D8 | | — | 0.04 | — | 0.08 | — | 0.07 | 1200 | 0.28 |
| | D9 | | 1.13 | 0.41 | 1.97 | — | — | 3.71 | 500 | 0.77 |
| | D10 | | — | — | 1.44 | 1.11 | — | 2.16 | 300 | 1.10 |
| | D11 | | 1.07 | 0.22 | — | 0.03 | — | 1.03 | 900 | 0.56 |
| | D12 | | — | — | — | 0.55 | — | 0.19 | 200 | 0.16 |
| Comparative Example | 13 | balance | — | — | — | — | 0.31 | 0 | 400 | 0 |
| | 14 | | — | — | — | 0.06 | — | −0.52 | 500 | 0.15 |
| | 15 | | — | — | — | — | — | 0.02 | 400 | 0.20 |
| | 16 | | — | 1.21 | 1.03 | — | — | 2.63 | 2500 | 1.60 |
| | 17 | | 1.10 | 0.23 | — | — | — | 1.05 | 200 | 0.05 |
| | 18 | | 2.12 | 2.57 | — | — | — | 4.42 | 1500 | 0.97 |
| | 19 | | — | 0.11 | 0.03 | — | — | 0.16 | 30 | 0.07 |
| | 20 | | 0.01 | — | — | 0.02 | — | 0.01 | 3000 | 0.11 |
| | 21 | | 1.90 | — | 2.89 | — | — | 4.94 | 100 | 0.33 |
| | 22 | | — | — | 1.33 | — | — | 1.64 | 30 | 0.05 |
| | 23 | | 1.49 | 0.88 | 2.43 | — | — | 5.07 | 2500 | 0.88 |
| | 24 | | — | 0.01 | — | 0.03 | — | 0.02 | 500 | 0.02 |

The corrosion resistant property against the ant-nest type corrosion, brazing and hot working properties of these examples and the comparative examples were evaluated by the following methods.

Corrosion Resistant Against the Ant-Nest Type Corrosion

Test pieces were exposed to the environment of formic acid as one of typical carboxylic, and the maximum corrosion depth was determined after corrosion. The test conditions were as follows:

Corrosion Medium:

100 ml of 1% aqueous solution of formic acid.

Exposure Condition:

the test piece (100 mm long) was dipped into deionized water in a beaker which was placed in a one liter container containing said corrosion medium, then the container was sealed.

Temperature and Testing Period:

maintained at 40° C. for 20 days.

Brazing Property

The finned coil was fabricated and the return bending part was brazed. The brazing property was evaluated by presence or absence of leakage. The conditions of brazing were as follows; brazing filler metal: BCuP-2, temperature: 850° C., brazing time:30 seconds. The air-tight test was carried out under air pressure of 2.94 MPa.

Hot Working

Using test sample, 15 mm in diameter and 15 mm long, selected from the ingots, the drop hammer test with the deformation rate of 50% was carried out at 850° C., and the presence of cracks was determined.

Results of these tests are shown in Table 7 below. Under the heading of "brazing property", "X" stands for presence of leakage and "○" for no leakage. Under heading of "hot-working property", "X" stands for presence of cracks and "C" for no crack.

TABLE 7

| | Corrosion Depth (mm) | Brazing Test | Hot Working Test |
|---|---|---|---|
| Example | | | |
| D1 | 0.02 | ○ | ○ |
| D2 | — | ○ | ○ |
| D3 | 0.01 | ○ | ○ |
| D4 | — | ○ | ○ |
| D5 | — | ○ | ○ |
| D6 | — | ○ | ○ |
| D7 | 0.02 | ○ | ○ |
| D8 | 0.03 | ○ | ○ |
| D9 | — | ○ | ○ |
| D10 | — | ○ | ○ |
| D11 | — | ○ | ○ |
| D12 | 0.02 | ○ | ○ |
| Comparative Example | | | |
| D13 | 0.24 | ○ | ○ |
| D14 | 0.27 | ○ | ○ |
| D15 | 0.19 | ○ | ○ |
| D16 | — | X | ○ |
| D17 | 0.16 | ○ | ○ |
| D18 | — | ○ | X |
| D19 | 0.16 | ○ | ○ |
| D20 | 0.20 | X | ○ |
| D21 | — | ○ | X |
| D22 | 0.15 | ○ | ○ |
| D23 | — | X | X |
| D24 | 0.22 | ○ | ○ |

As obvious from Table 7, in the examples D1 through D12, the corrosion depth was very thin and 0.03 mm or less, the brazing and hot working properties were also good. On the other hand, the comparative examples D13, D14, D15, D20 and D24 showed small value for the equation (5) (0.02 or less) as shown under the heading of [ ] but rated with high value of 0.19 mm or more for the corrosion depth. The comparative examples D18, D21 and D23 showed high value of 4.42 or more for the equation (5) and also poor hot working property. The comparative examples D16, D20 and D23 having thick oxide film of 2500 Å or more showed poor brazing property. The comparative examples D13, D17, D19, D22 and D24 having lower value of the peak intensity ratio Ix/ICu (0.07 or less) showed unsatisfactory corrosion resistant property.

What is claimed is:

1. A corrosion resistant copper alloy tube consisting essentially of 0.05 to 1.5 wt. % of Mn, 0.002 to 0.15 wt. % of B, 100 ppm or less of oxygen, and Cu and inevitable impurities, wherein the ratio (Mn/B) of said Mn to said B is in the range from 2 to 100.

2. A corrosion resistant copper alloy tube consisting essentially of 0.05 to 1.5 wt. % of Mn, 0.002 to 0.15 wt. % of P and B, 100 ppm or less of oxygen, and Cu and inevitable impurities, wherein the ratio {Mn/(P+B)} of said Mn to said P and B is in the range from 2 to 100.

* * * * *